US009743169B2

(12) United States Patent
Lee et al.

(10) Patent No.: US 9,743,169 B2
(45) Date of Patent: Aug. 22, 2017

(54) SOUND OUTPUT METHOD AND DEVICE UTILIZING THE SAME

(71) Applicant: Samsung Electronics Co., Ltd., Gyeonggi-do (KR)

(72) Inventors: Jungwon Lee, Gyeonggi-do (KR); Sunyoung Yi, Gyeonggi-do (KR); Bokeun Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 10 days.

(21) Appl. No.: 14/822,495

(22) Filed: Aug. 10, 2015

(65) Prior Publication Data

US 2016/0044401 A1 Feb. 11, 2016

(30) Foreign Application Priority Data

Aug. 8, 2014 (KR) ..... 10-2014-0102264

(51) Int. Cl.
*H04R 1/10* (2006.01)
*H04R 5/033* (2006.01)

(52) U.S. Cl.
CPC ..... *H04R 1/1041* (2013.01); *H04R 5/0335* (2013.01); *H04R 2201/107* (2013.01); *H04R 2420/07* (2013.01)

(58) Field of Classification Search
CPC ..... H04R 2420/07; H04R 1/1041; H04R 2201/107; H04R 27/00; H04R 3/005; H04R 1/1091; H04R 2201/109; H04R 2499/11; H04R 5/0335; H04N 21/4622; H04N 21/4623; H04N 21/47202; H04N 5/23203; H04N 5/23212; H04N 5/23219
USPC ..... 381/77, 82, 98, 1, 104–107, 56–59, 74, 381/79, 97, 190, 312, 331, 315; 700/94
See application file for complete search history.

(56) References Cited

U.S. PATENT DOCUMENTS

2008/0317274 A1* 12/2008 Kim ..... H04R 1/1058 381/370
2010/0166207 A1* 7/2010 Masuyama ..... H04R 1/1041 381/74
2013/0094680 A1* 4/2013 Allen ..... H04R 1/1041 381/190

FOREIGN PATENT DOCUMENTS

GB 2318673 * 4/1998 ..... G04B 13/14
KR 200411968 3/2006
KR 1020070075024 7/2007

* cited by examiner

*Primary Examiner* — Lao Lun-See
(74) *Attorney, Agent, or Firm* — The Farrell Law Firm, P.C.

(57) ABSTRACT

A sound output device and method are provided. The device includes a first speaker and a second speaker; a first coupling unit and a second coupling unit which can be coupled to the first coupling unit; a sensor module for sensing at least one of a coupling state between the first coupling unit and the second coupling unit, a separation distance, and a separation time; a communication module for forming a communication channel with an electronic device; and a processor for receiving sound information corresponding to a sound output function from the electronic device, generating control information for controlling the sound output function on the basis of at least one of the coupling state between the first coupling unit and the second coupling unit, the separation distance, and the separation time, and transmitting the generated control information to the electronic device.

19 Claims, 15 Drawing Sheets

SOUND OUTPUT METHOD AND DEVICE UTILIZING THE SAME

PRIORITY

This application claims priority under 35 U.S.C. §119(a) to Korean Patent Application No. 10-2014-0102264, filed on Aug. 8, 2014, the contents of which are incorporated herein by reference.

BACKGROUND

1. Field of the Invention

The present invention generally relates to a sound output method and a device utilizing the same.

2. Description of the Related Art

A mobile phone, such as a broadcasting phone or a Portable Multimedia Player (PMP) phone has a built-in multimedia player as a main function therein. Accordingly, a user of such mobile phone can enjoy various contents through the mobile phone, and a demand for a sound output device (referred to as "earphone" or "headset") is recently increasing.

Bluetooth® is a standard for performing low-power wireless communication in a local area network, and processing information transmission between devices such as a computer, a mobile phone, a headset, a personal mobile information terminal, such as a Personal Data Assistant (PDA), a Personal Computer (PC), and a printer. Bluetooth® is a communication technology which can transmit and receive data wirelessly between ten to a maximum of several hundred meters. The data transmission speed of Bluetooth® is 433.9 kbps in a symmetrical communication mode and 723.2 kbps in an asymmetrical communication mode. For voice transmission, a 64 kbps synchronization transmission scheme and the like are used. Bluetooth® processes inquiry functions and the like through wireless access and mobile communication between a wireless headset, a wireless keyboard, a PDA, a laptop, a camera and a mobile terminal and a peripheral device.

A magnet embedded in a sound output device, i.e., a headset or an earphone, has been used to couple both ends of the device. A user controls an electronic device that is wirelessly connected to the sound output device, using a button located in a cover of the sound output device. However, due to the size of the headset and earphone, the button is small in size, and the user will often have a problem properly using the button.

SUMMARY

The present invention has been made to address the above-mentioned problems and disadvantages, and to provide at least the advantages described below. Accordingly, an aspect of the present invention provides a sound output method and an apparatus utilizing the same, and provides a sound output device for sensing a coupling state between a first coupling unit and a second coupling unit, a separation distance, and a separation time and controlling a sound output function of an electronic device. Further, an aspect of the present invention provides the electronic device for receiving control information from the sound output device and controlling a sound output function.

In accordance with an aspect of the present invention, a method for outputting a sound by a sound output device in which a first coupling unit and a second coupling unit can be coupled to each other includes receiving sound information according to a sound output function from an electronic device; sensing at least one of the coupling state between the first coupling unit and the second coupling unit, a separation distance between the first coupling unit and the second coupling unit, and a separation time; and generating control information for controlling the sound output function of the electronic device on the basis of at least one of the coupling state between the first coupling unit and the second coupling unit, the separation distance, and the separation time, and transmitting the generated control information to the electronic device.

In accordance with another aspect of the present invention, a sound output device includes a first speaker; a second speaker; a first coupling unit; a second coupling unit configured to be coupled to the first coupling unit; a sensor module for sensing at least one of a coupling state between the first coupling unit and the second coupling unit, a separation distance between the first coupling unit and the second coupling unit, and a separation time; a communication module for forming a communication channel with an electronic device; and a processor for receiving sound information according to a sound output function from the electronic device, generating control information for controlling the sound output function on the basis of at least one of the coupling state between the first coupling unit and the second coupling unit, the separation distance, and the separation time, and transmitting the generated control information to the electronic device.

A sound output device according to embodiments of the present invention senses a coupling state between a first coupling unit and a second coupling unit and control an electronic device. Further, the sound output device does not require separate operation buttons, thereby improving user convenience.

BRIEF DESCRIPTION OF THE DRAWINGS

The above and other aspects, features and advantages of the present invention will be more apparent from the following detailed description, taken in conjunction with the accompanying drawings, in which.

DETAILED DESCRIPTION OF EMBODIMENTS OF THE PRESENT INVENTION

Figure 1:
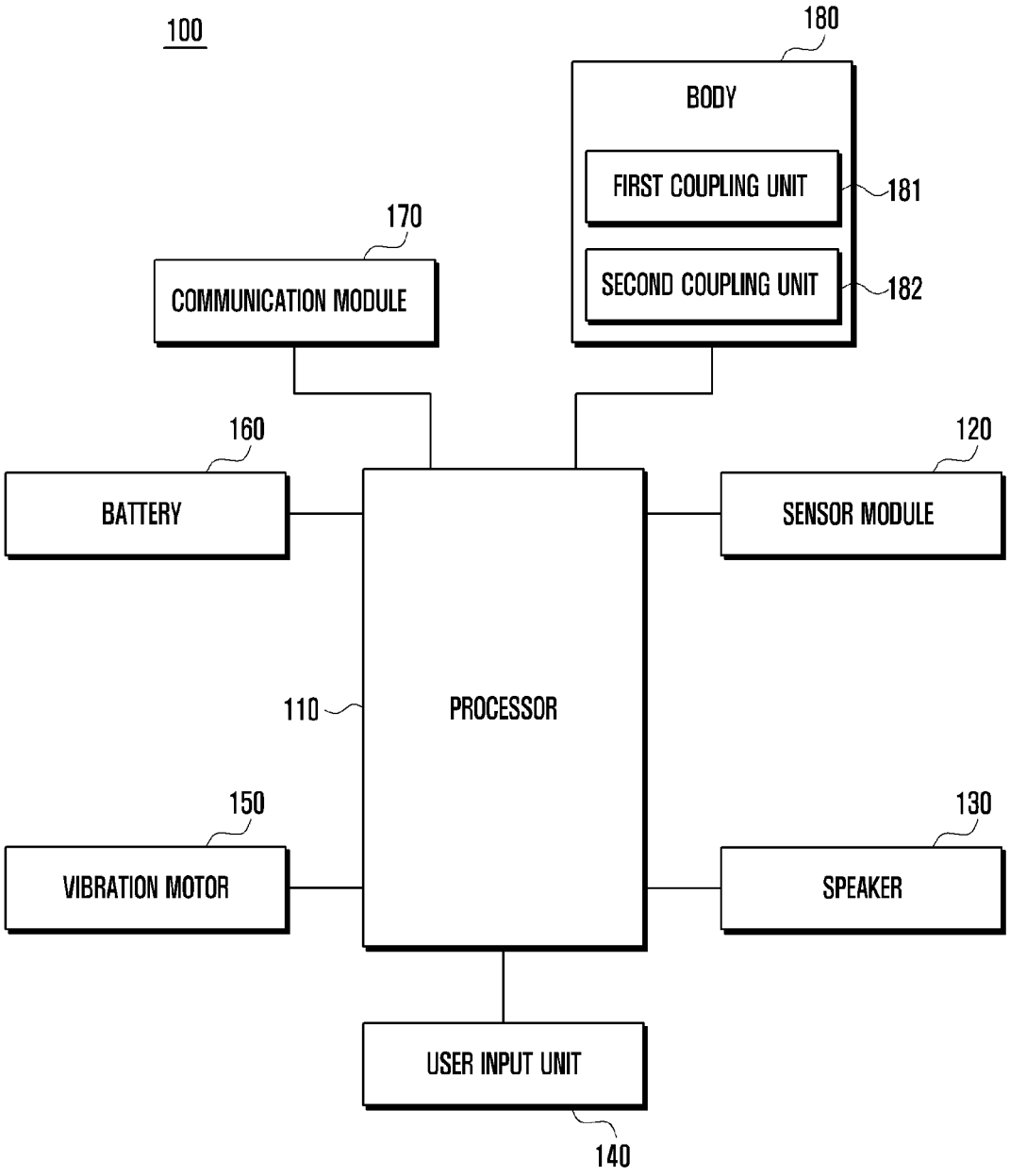
FIG. 1 is a block diagram of a sound output device according to an embodiment of the present invention.

Herein, embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

The terms and words used in the following description and claims are not limited to the meanings found in an ordinary dictionary, but are merely used to enable a clear and consistent understanding of the present disclosure. Accordingly, it should be apparent to those skilled in the art that the following description of embodiments of the present disclosure is provided for illustration purposes only and not for the purpose of limiting the present invention as defined by the appended claims and their equivalents.

As used herein, the singular forms "a", "an", and "the" are intended to include the plural forms, including "at least one", unless the content clearly indicates otherwise. The term "or" means "and/or". As used herein, the term "and/or" includes any and all combinations of one or more of the associated listed items. It will be further understood that the terms "comprises" and/or "comprising", or "includes" and/or "including" when used herein, specify the presence of stated features, regions, integers, steps, operations, elements, and/or components, but do not preclude the presence or addition of one or more other features, regions, integers, steps, operations, elements, components, and/or groups thereof.

It will be understood that, although the terms "first", "second", "third", etc. may be used herein to describe various elements, components, regions, layers and/or sections, these elements, components, regions, layers, and/or sections should not be limited by these terms. These terms are only used to distinguish one element, component, region, layer, or section from another element, component, region, layer, or section. Thus, a first element, component, region, layer, or section could also be referred to as a second element, component, region, layer or section, and vice versa, without departing from the teachings herein.

Herein, an electronic device may be a device that involves a communication function. For example, an electronic device may be embodied as a smart phone, a tablet PC (Personal Computer), a mobile phone, a video phone, an e-book reader, a desktop PC, a laptop PC, a netbook computer, a PDA (Personal Digital Assistant), a PMP (Portable Multimedia Player), an MP3 player, a portable medical device, a digital camera, or a wearable device (e.g., a Head-Mounted Device (HMD) such as electronic glasses, electronic clothes, an electronic bracelet, an electronic necklace, an electronic appcessory, or a smart watch).

According to an embodiment of the present invention, an electronic device may be a smart home appliance that involves a communication function. For example, an electronic device may be a Television (TV), a Digital Versatile Disc (DVD) player, audio equipment, a refrigerator, an air conditioner, a vacuum cleaner, an oven, a microwave, a washing machine, an air cleaner, a set-top box, a TV box, a game console, an electronic dictionary, an electronic key, a camcorder, or an electronic picture frame.

According to an embodiment of the present invention, an electronic device may be a medical device (e.g., Magnetic Resonance Angiography (MRA), Magnetic Resonance Imaging (MRI), Computed Tomography (CT), ultrasonography, etc.), a navigation device, a Global Positioning System (GPS) receiver, an Event Data Recorder (EDR), an Flight Data Recorder (FDR), a car infotainment device, electronic equipment for ship (e.g., a marine navigation system, a gyrocompass, etc.), avionics, security equipment, or an industrial or home robot.

According to an embodiment of the present invention, an electronic device may be furniture or part of a building or construction having a communication function, an electronic board, an electronic signature receiving device, a projector, or various measuring instruments (e.g., a water meter, an electric meter, a gas meter, a wave meter, etc.). An electronic device disclosed herein may be one of the above-mentioned devices or any combination thereof. As well understood by those skilled in the art, the above-mentioned electronic devices are provided as examples only and are not to be considered a limitation of this disclosure.

A sound output device according to the present invention can be a device including a communication function. For example, a sound output device can be a combination of one or more of various devices such as a wired earphone, a wireless earphone, a wired headset, or a wireless headset. It is obvious to those skilled in the art that the sound output device according to the present invention is not limited to the above-described devices.

FIG. 1 illustrates a block diagram of a sound output device 100 according to an embodiment of the present invention.

Referring to FIG. 1, the sound output device 100 includes a processor 110, a sensor module 120, a speaker 130, a user input unit 140, a vibration motor 150, a battery 160, a communication module 170, and a body 180.

The sensor module 120 senses at least one of a coupling state between a first coupling unit and a second coupling unit of the sound output device 100, a separation distance, and a separation time, and converts the sensed information into an electric signal. The sensor module 120 includes at least one of a Hall sensor (Hall IC), a capacitive sensor, and a proximity sensor. A Hall sensor is a sensor for sensing a change in magnetic field. Further, when the first coupling unit and the second coupling unit are coupled to each other, the Hall sensor senses at least one of the coupling state between the first coupling unit and the second coupling unit, the separation distance, and the separation time. A capacitive sensor is a sensor for sensing a change in electric capacity of a capacitor, and can sense at least one of the coupling state between the first coupling unit and the second coupling unit, a separation distance, and a separation time when the electric capacity of the capacitor changes. A proximity sensor can sense emitted infrared rays reflected from an object, to sense whether the object is close to the sensor. Further, the proximity sensor can sense at least one of the coupling state between the first coupling unit and the second coupling unit, a separation distance, and a separation time when the sound output device 100 is provided with the proximity sensor. The sensor module 120 may further include a control circuit for controlling at least one sensor included therein.

The speaker 130 converts sound information received from an electronic device into a sound and output the sound.

The user input unit 140 receives a command or a voice input from a user, and may include a button and a microphone. The button may include at least one of a button for adjusting volume, a button for controlling a call connection or a button for controlling music reproduction. The microphone may be used for making a phone call, or recording through an electronic device. The microphone may be provided at a position close to the mouth of a user, and may be located at one end of the sound output device 100.

The vibration motor 150 vibrates a body of the sound output device 100 and functions as notification to a user. When a phone call is received in the electronic device, when a message is received in the electronic device, or the like occurs so that a notification function is performed, the sound output device 100 can use the vibration motor 150 so as to enable a user to recognize the event has occurred without having to look at the electronic device.

The battery 160 is provided in the body 180 of the sound output device 100 and supplies power so as to allow each part of the sound output device 100 to work. A re-chargeable secondary battery may be used as the battery 160. Further, the battery 160 may be a detachable type battery or an embedded type battery.

The communication module 170 forms a communication channel between the sound output device 100 and the electronic device, thereby enabling communication between the two devices. For example, the communication module 170 can communicate with the electronic device through wireless communication or wired communication. The wireless communication may include at least one of, for example, Wi-Fi, Bluetooth® (BT), Near Field Communication (NFC), Global Positioning System (GPS) or cellular communication (e.g. LTE, LTE-A, CDMA, WCDMA, UMTS, WiBro, or GSM, etc.). The wired communication may include at least one of, for example, a Universal Serial Bus (USB), a High Definition Multimedia Interface (HDMI), Recommended Standard 232 (RS-232), or a Plain Old Telephone Service (POTS). Desirably, the present invention can connect communication between the sound output device and the electronic device, using a Bluetooth® module.

Figure 2:
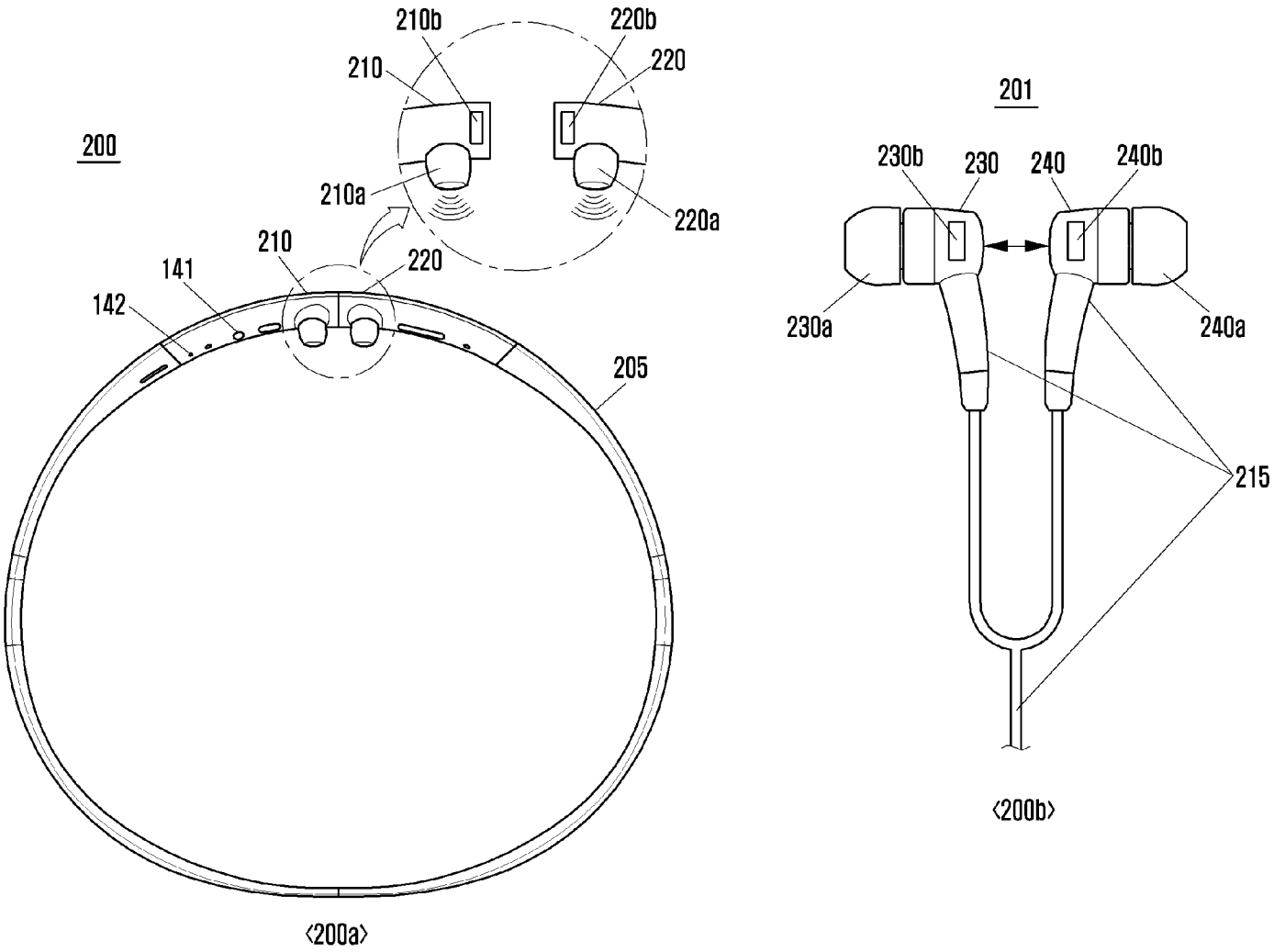
FIG. 2 illustrates a shape of a sound output device according to an embodiment of the present invention.

The body 180 of the sound output device 100 can be formed as a single case. When the body 180 is formed as a single case, a user can wear the sound output device 100 on his/her head or around his/her neck by bending the sound output device 100 in the form of a C-shaped circular arc. FIG. 2 illustrates sound output device 200*a* with a body 205 formed by a single case. When the sound output device 100 has an earphone-shaped body, the body may include two cases and a wire connecting the two cases. When the body 180 is formed of two cases, a user can wear the two cases around his/her ears, respectively. A sound output device 201 with a body formed of two cases is shown as 200*b* of FIG. 2.

The body 180 includes a first coupling unit 181, and a second coupling unit 182. The first coupling unit 181 can be coupled to or separated from the second coupling unit 182. Depending on whether the first coupling unit 181 and the second coupling unit 182 are coupled or separated, the sound output device 100 can generate control information for controlling the sound output function of the electronic device.

The processor 110 receives power from the battery 160 and controls each part of the sound output device 100. For example, the processor 110 receives sound information according to the sound output function from the electronic device, generates control information for controlling the sound output function on the basis of at least one of the coupling state between the first coupling unit and the second coupling unit, a separation distance, and a separation time, and transmits the generated control information to the electronic device.

FIG. 2 illustrates shapes of sound output devices 200 and 201 according to an embodiment of the present invention.

Referring to 200*a* of FIG. 2, the sound output device 200 according to an embodiment of the present invention can be provided in the form of a loop type headset. The sound output device 200 may have a body 205 including a first speaker, a second speaker, a first coupling unit 210, a second coupling unit 220, a button 141, and a microphone 142. The body 205 is formed as a single case and can be worn around a neck or a head of a user. According to the present invention, a first coupling unit 210 and a second coupling unit 220 may include a speaker, speaker protection units 210*a* and 220*a*, respectively, and magnets 210*b* and 220*b*, respectively. The first speaker and the second speaker output sound information. The speaker protection units 210*a* and 220*a* are made from an elastic material, which can help a user secure the speaker protection units in his/her ears softly and can protect the speaker from foreign substances. The first coupling unit 210 and the second coupling unit 220 can be coupled, using magnetic force by the magnets 210*b* and 220*b*. According to an embodiment of the present invention, the first coupling unit 210 and the second coupling unit 220 may include only the magnets 210*b* and 220*b*, respectively. The sensor module 120 can sense the coupling state between the first coupling unit 210 and the second coupling unit 220. Further, when the first coupling unit 210 and the second coupling unit 220 are separated from each other, the sensor module 120 can sense at least one of a separation distance and a separation time between the first coupling unit 210 and the second coupling unit 220. The button 141 may include at least one of a button for adjusting volume, a button for controlling a call connection or a button for controlling music reproduction. The microphone 142 may be used for making a phone call, or recording through an electronic device. The microphone may be provided at a position close to the mouth of a user, and may be located at one end of the sound output device 200.

Referring to 200*b* of FIG. 2, the sound output device 201 according to the present invention can be provided in the form of earphones. The sound output device 201 may have a body 215 including a first speaker, a second speaker, a first coupling unit 230, a second coupling unit 240, a button, and a microphone. The body 215 is formed of two cases and can be worn around or inside ears of a user. According to an embodiment of the present invention, the first coupling unit 230 and the second coupling unit 240 include a speaker, speaker protection units 230*a* and 240*a*, respectively, and magnets 230*b* and 240*b*, respectively. The first coupling unit 230 and the second coupling unit 240 can be coupled, using magnetic force by the magnets 230*b* and 240*b*. According to the present invention, the first coupling unit 230 and the second coupling unit 240 may include only the magnets 230*b* and 240*b*. The sensor module 120 can sense the coupling state between the first coupling unit 230 and the second coupling unit 240. Further, when the first coupling unit 230 and the second coupling unit 240 are separated from each other, the sensor module 120 can sense at least one of a separation distance and a separation time between the first coupling unit 230 and the second coupling unit 240. The button may include at least one of a button for adjusting volume, a button for controlling a call connection or a button for controlling music reproduction. The microphone may be used for making a phone call, or recording through an electronic device. The microphone can be provided at a position close to the mouth of a user, and can be located at one end of the sound output device 200.

Figure 3A:
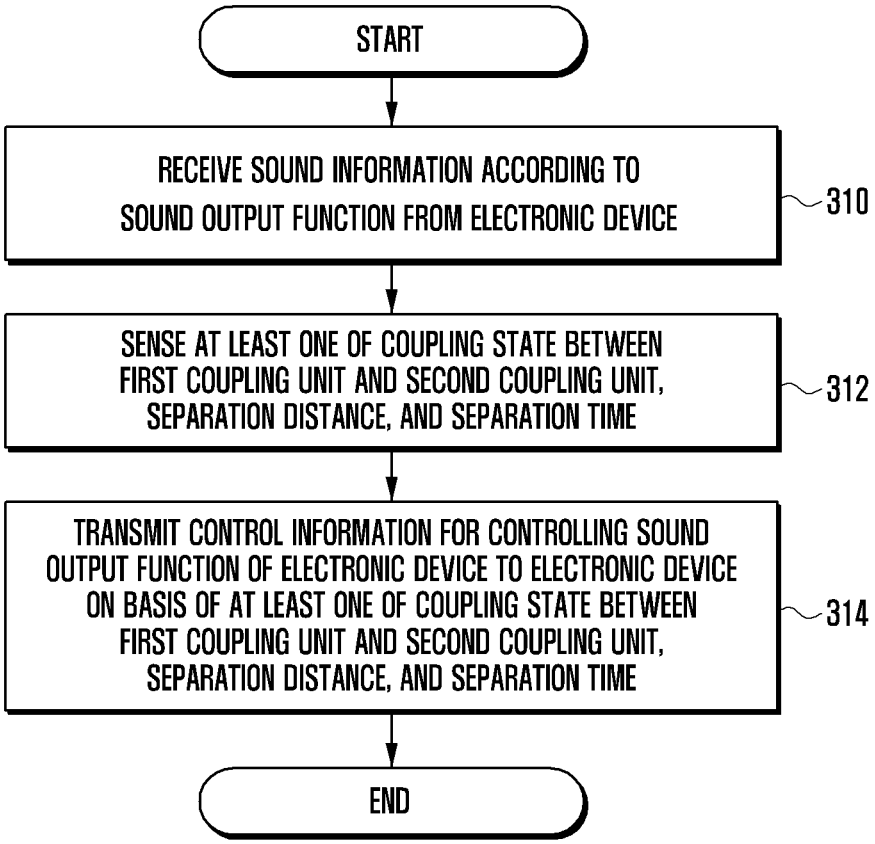
FIG. 3A is a flow chart of a control information transmission operation of a sound output device according to an embodiment of the present invention.

FIG. 3A is a flow chart of a control information transmission operation of a sound output device 300 according to various embodiments of the present invention.

Figure 3B:
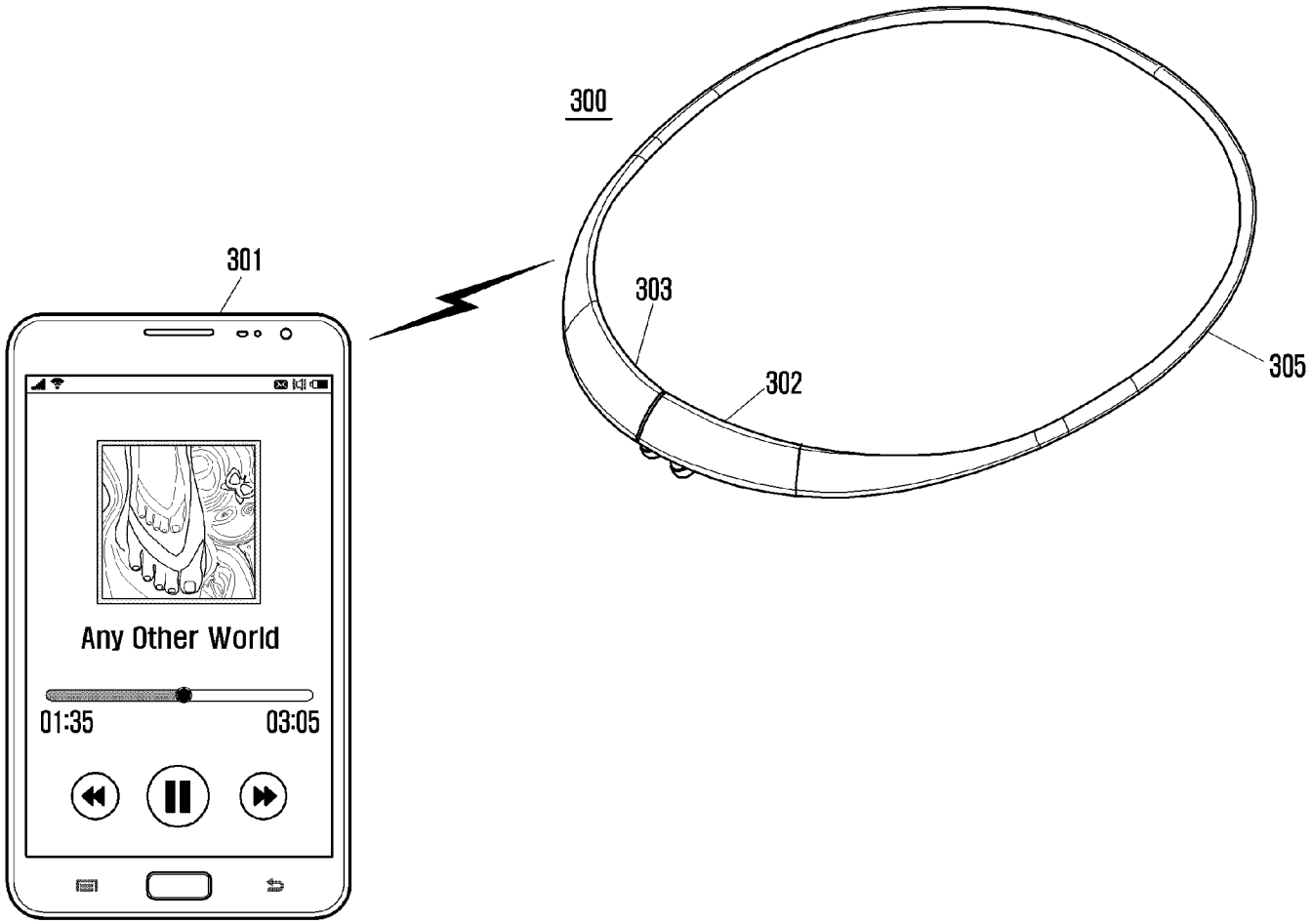
FIG. 3B illustrates components of the control information transmission operation of FIG. 3A.

FIG. 3B illustrates components of the control information transmission operation of FIG. 3A.

Referring to FIGS. 3A and 3B, the sound output device 300 is connected to an electronic device 301 in step 310 and receives sound information according to a sound output function from the electronic device 301. The sound output function may include various functions performed in the electronic device 301, such as a call reception standby function, a call reception rejecting function, a phone call function, a standby mode function, and a media reproduction function. The sound information received from the electronic device 301 may include an audio signal according to the sound output function. For example, the sound output device 300 can output the audio signal included in the sound information through a speaker.

According to an embodiment of the present invention, as shown in FIG. 3B, when the media reproduction function is being performed in the electronic device 301, the sound output device 300 can receive sound information according to media reproduction function. When music is being reproduced, the sound output device 300 can receive sound information including a melody of the corresponding music, and when a video is being reproduced, the sound output device 300 can receive sound information including a background sound of the corresponding video. The sound output device 300 can output the sound information as a sound through a first speaker and a second speaker.

The sound output device 300 can sense at least one of a coupling state between a first coupling unit 302 and a second coupling unit 303 which are included in a body 305, a separation distance, and a separation time through the sensor module 120 in step 312. The coupling state between the first coupling unit 302 and the second coupling unit 303 may include a state in which the first coupling unit 302 and the second coupling unit 303 are in direct contact with each other, and a state in which the first coupling unit 302 and the second coupling unit 303 are within a predetermined distance. The coupling of the first coupling unit 302 and the second coupling unit 303 can be achieved using magnetic force. Further, according to the present invention, if a user separates the first coupling unit 302 and the second coupling unit 303 in order to hear a voice from a speaker, the sound output device 300 can sense the coupling state between the first coupling unit 302 and the second coupling unit 303 as "OFF". Further, if a user couples the first coupling unit 302 and the second coupling unit 303 together in order not to use a speaker, the sound output device 300 can sense the coupling state between the first coupling unit 302 and the second coupling unit 303 as "ON".

According to the present invention, if a user separates the first coupling unit 302 and the second coupling unit 303 in order to hear a voice, the sound output device 300 can sense the separation distance between the first coupling unit 302 and the second coupling unit 303.

According to the present invention, if a user separates the first coupling unit 302 and the second coupling unit 303 in order to hear a voice from a speaker, the sound output device 300 can sense the separation time between the first coupling unit 302 and the second coupling unit 303, such as the elapsed time from when the first coupling unit 302 and the second coupling unit 303 are separated from each other. The sound output device 300 can use at least one of a Hall sensor (Hall IC), a capacitive sensor, or a proximity sensor in order to sense one of whether the first coupling unit 302 and the second coupling unit 303 are coupled, a separation distance, and a separation time.

The sound output device 300 can transmit control information for controlling the sound output function of the electronic device 301 to the electronic device 301 on the basis of at least one of the coupling state between the first coupling unit 302 and the second coupling unit 303, a separation distance, and a separation time in step 314.

According to the present invention, if a call reception standby function is performed in the electronic device 301, the sound output device 300 can receive sound information according to the call reception standby function from the electronic device 301. The sound information may include an audio signal indicating a sound of a bell so as to enable a user to be aware of an incoming call, and the sound output device 300 can output the sound of the bell on the basis of the audio signal. When a user separates the first coupling unit 302 and the second coupling unit 303 in order to make a phone call, the sound output device 300 can sense the separation and transmit control information for activating a phone call function to the electronic device 301.

According to the present invention, if a call reception standby function is performed in the electronic device 301, the sound output device 300 can receive sound information according to the call reception standby function from the electronic device 301. When a user separates and then couples the first coupling unit 302 and the second coupling unit 303 again in order to reject a call reception, the sound output device 300 can sense the recoupling and transmit control information for activating a call reception rejecting function to the electronic device 301.

According to the present invention, if a phone call function is performed in the electronic device 301, the sound output device 300 can receive sound information according to the phone call function from the electronic device 301. The sound information can include an audio signal indicating a voice of a calling counterpart, and the sound output device 300 can output a sound on the basis of the audio signal. When a user couples the first coupling unit 302 and the second coupling unit 303 in order to terminate a phone call, the sound output device 300 can sense the coupling and transmit control information to discontinue a phone call function to the electronic device 301.

According to the present invention, if a standby mode function is performed in the electronic device 301, the sound output device 300 can receive sound information according to the standby mode function from the electronic device 301. The sound information can include an audio signal indicating a sound effect of the electronic device 301 which is in a standby mode, and the sound output device 300 can output a sound on the basis of the audio signal. When a user separates the first coupling unit 302 and the second coupling unit 303 in order to reproduce a media while in the standby mode, the sound output device 300 can sense the separation and transmit control information for activating a media reproduction function to the electronic device 301.

According to the present invention, if a media reproduction function is performed in the electronic device 301, the sound output device 300 can receive sound information according to the media reproduction function from the electronic device 301. The sound information can include an audio signal indicating a sound effect or a background sound according to media reproduction, and the sound output device 300 can output a sound on the basis of the audio signal. When a user couples the first coupling unit 302 and the second coupling unit 303 in order to terminate media reproduction, the sound output device 300 can sense the coupling and transmit control information to discontinue a media reproduction function to the electronic device 301.

Figure 4A:
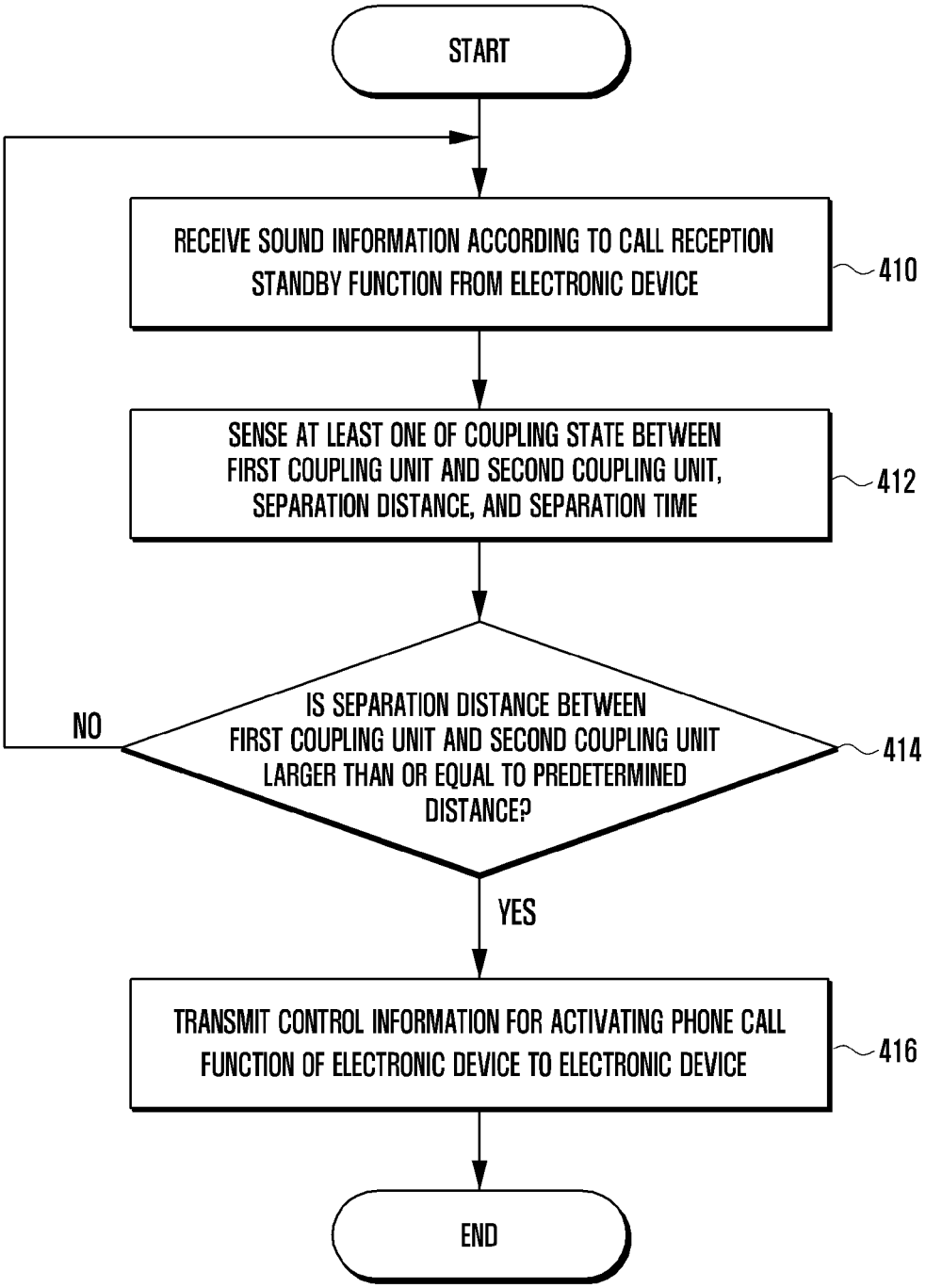
FIG. 4A is a flow chart of an operation of transmitting control information for activating a phone call function to an electronic device by a sound output device according to an embodiment of the present invention.

FIG. 4A is a flow chart of an operation of transmitting control information for activating a phone call function to the electronic device 301 by the sound output device 300 according to an embodiment of the present invention.

Figure 4B:
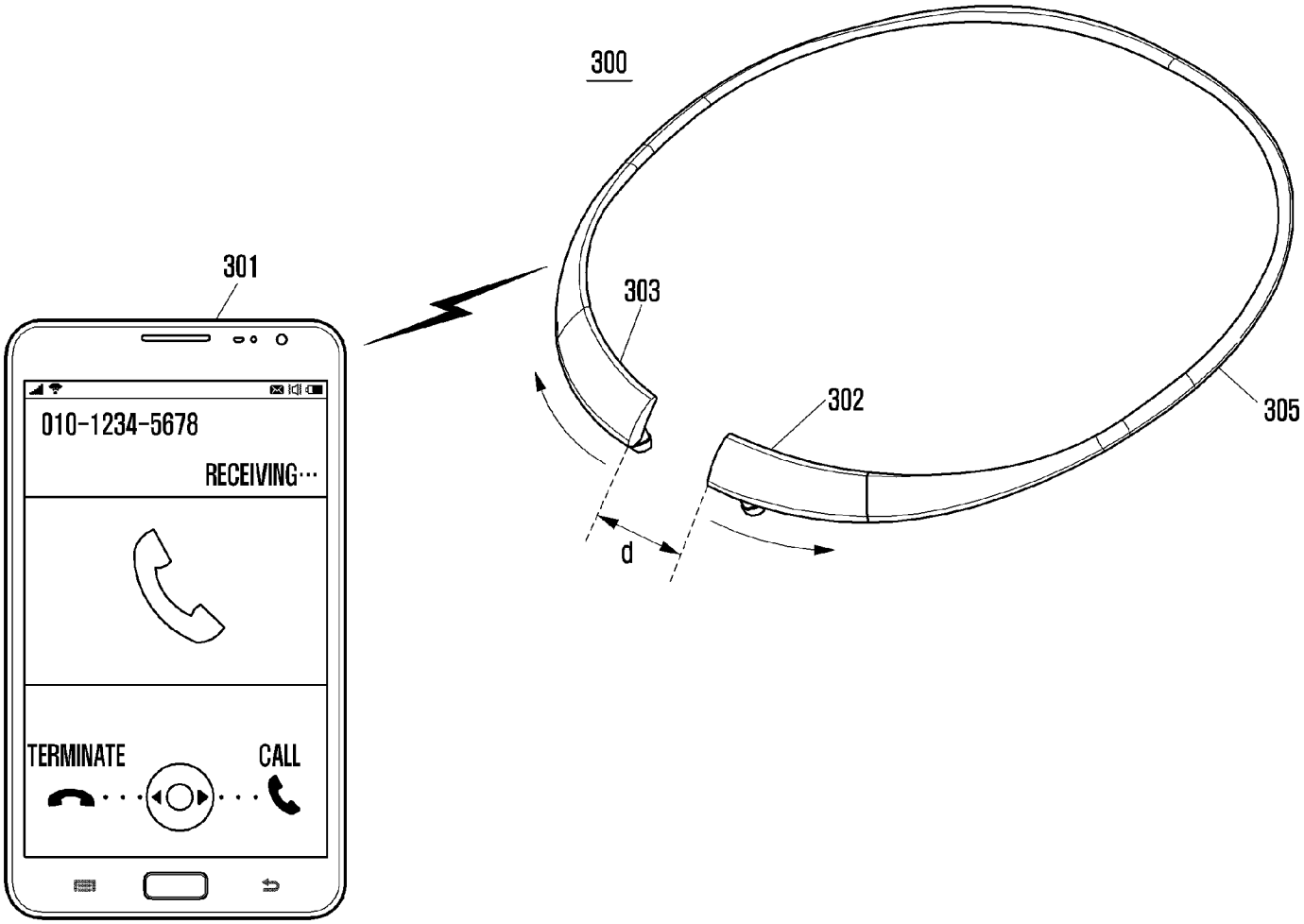
FIG. 4B illustrates components of the control information transmission operation of FIG. 4A.

FIG. 4B illustrates components of the control information transmission operation of FIG. 4A.

Referring to FIGS. 4A and 4B, the sound output device 300 is connected to the electronic device 301 in step 410 and can receive sound information according to a call reception standby function from the electronic device 301.

According to the present invention, the sound output device 300 can receive vibration echo information according to a call reception standby function from the electronic device 301. The vibration echo information can include a signal for controlling the vibration motor 150, to enable a user to be aware of an incoming call. The sound output device 300 can operate the vibration motor 150 on the basis of a signal for controlling the vibration motor.

The sound output device 300 can sense at least one of the coupling state between the first coupling unit 302 and the second coupling unit 303 which are included in the body 305, a separation distance, and a separation time through the sensor module 120 in step 412. For example, as shown in FIG. 4B, if a user separates the first coupling unit 302 and the second coupling unit 303 in order to make a phone call, the sound output device 300 can sense the separation between the first coupling unit 302 and the second coupling unit 303. Further, the sensor module 120 can sense a separation distance d or a separation time between the first coupling unit 302 and the second coupling unit 303.

According to the present invention, the sound output device 300 can sense the elapsed time from when the first coupling unit 302 and the second coupling unit 303 are separated from each other, as the separation time. Further, the sound output device 300 can sense the elapsed time from when a distance between the first coupling unit 302 and the second coupling unit 303 is greater than or equal to a predetermined distance, as the separation time. For example, the sound output device 300 can measure how much time passes from when a user spaces the first coupling unit 302 and the second coupling unit 303 away from each other by a predetermined distance. The separation distance d or the separation time can be used for generating control information for activating a phone call function.

If the first coupling unit 302 and the second coupling unit 303 are separated from each other, the sound output device 300 can determine whether the separation distance d between the first coupling unit 302 and the second coupling unit 303 is greater than or equal to a predetermined distance in step 414. The predetermined distance may be set as a distance between both ears of a user, for example, 20 cm.

If the separation distance d between the first coupling unit 302 and the second coupling unit 303 is greater than or equal to the predetermined distance, the sound output device 300 can transmit control information for activating a phone call function of the electronic device 301 to the electronic device 301 in step 416. For example, if the predetermined distance is set as 20 cm, when a user spaces first coupling unit 302 and the second coupling unit 303 away from each other by the distance d of 25 cm, the sound output device 300 can sense the spacing and generate control information for activating a phone call function. After that, the sound output device 300 can activate a phone call function by transmitting the generated control information to the electronic device 301.

According to the present invention, if a predetermined time elapses from when the separation distance d between the first coupling unit 302 and the second coupling unit 303 is greater than or equal to the predetermined distance, the sound output device 301 can transmit control information for activating a phone call function of the electronic device 301 to the electronic device 301. For example, if the predetermined distance is set as 20 cm and the predetermined time is set as two seconds, when two seconds elapse from when a user spaces the first coupling unit 302 and the second coupling unit 303 away from each other by the distance d of 20 cm in order to hear a voice through a speaker, the sound output device 300 can sense the elapsed time and generate control information for activating a phone call function. After that, the sound output device 300 can activate a phone call function by transmitting the generated control information to the electronic device 301.

If the separation distance d between the first coupling unit 302 and the second coupling unit 303 is less than the predetermined distance, the sound output device 300 returns to step 410 and maintains the operation of receiving sound information according to a call reception standby function from the electronic device.

Figure 5A:
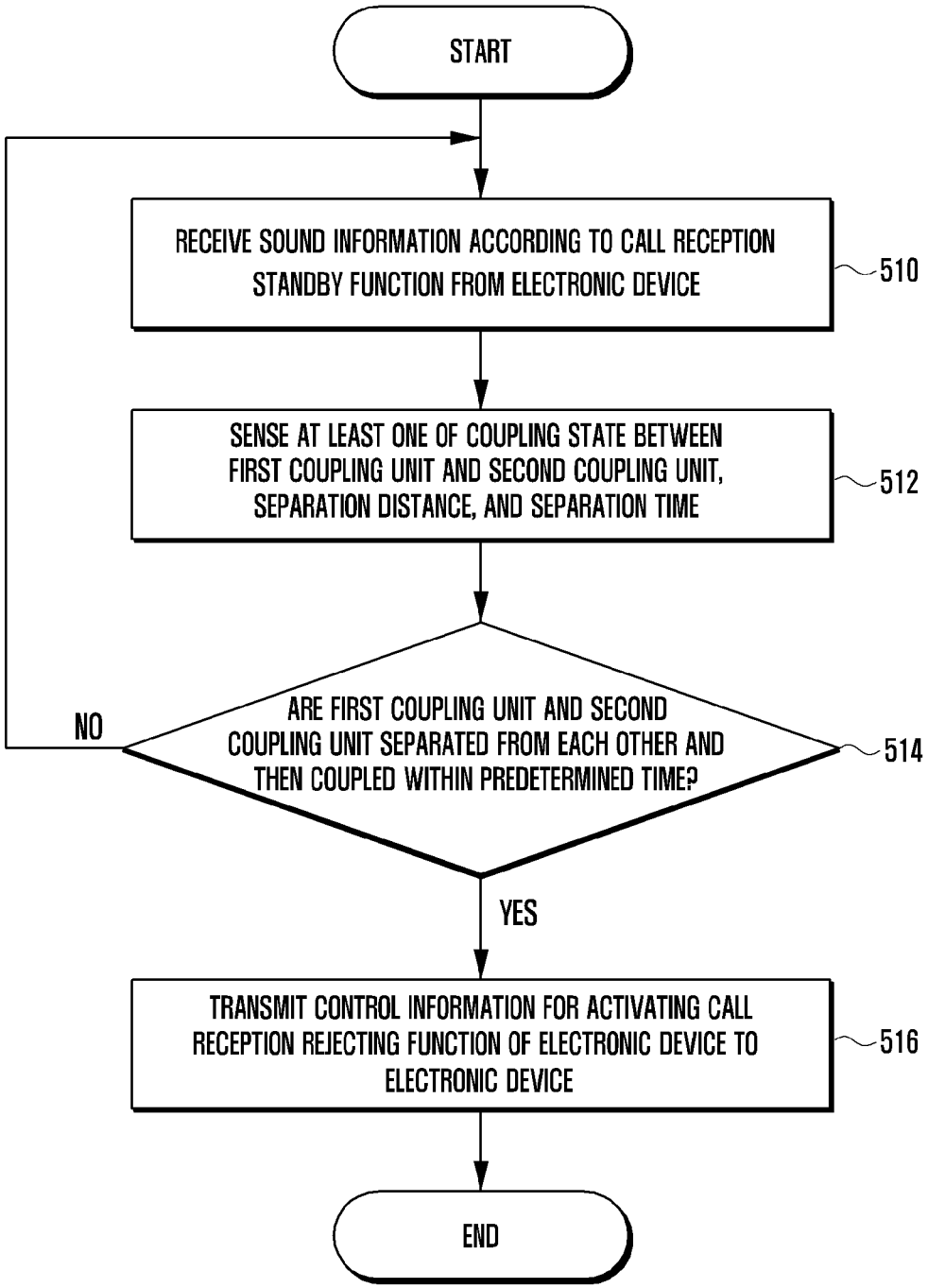
FIG. 5A is a flow chart of an operation of transmitting control information for activating a call reception rejecting function to an electronic device by a sound output device according to an embodiment of the present invention.

FIG. 5A is a flow chart of an operation of transmitting control information for activating a phone call function to the electronic device 301 by the sound output device 300 according to an embodiment of the present invention.

Figure 5B:
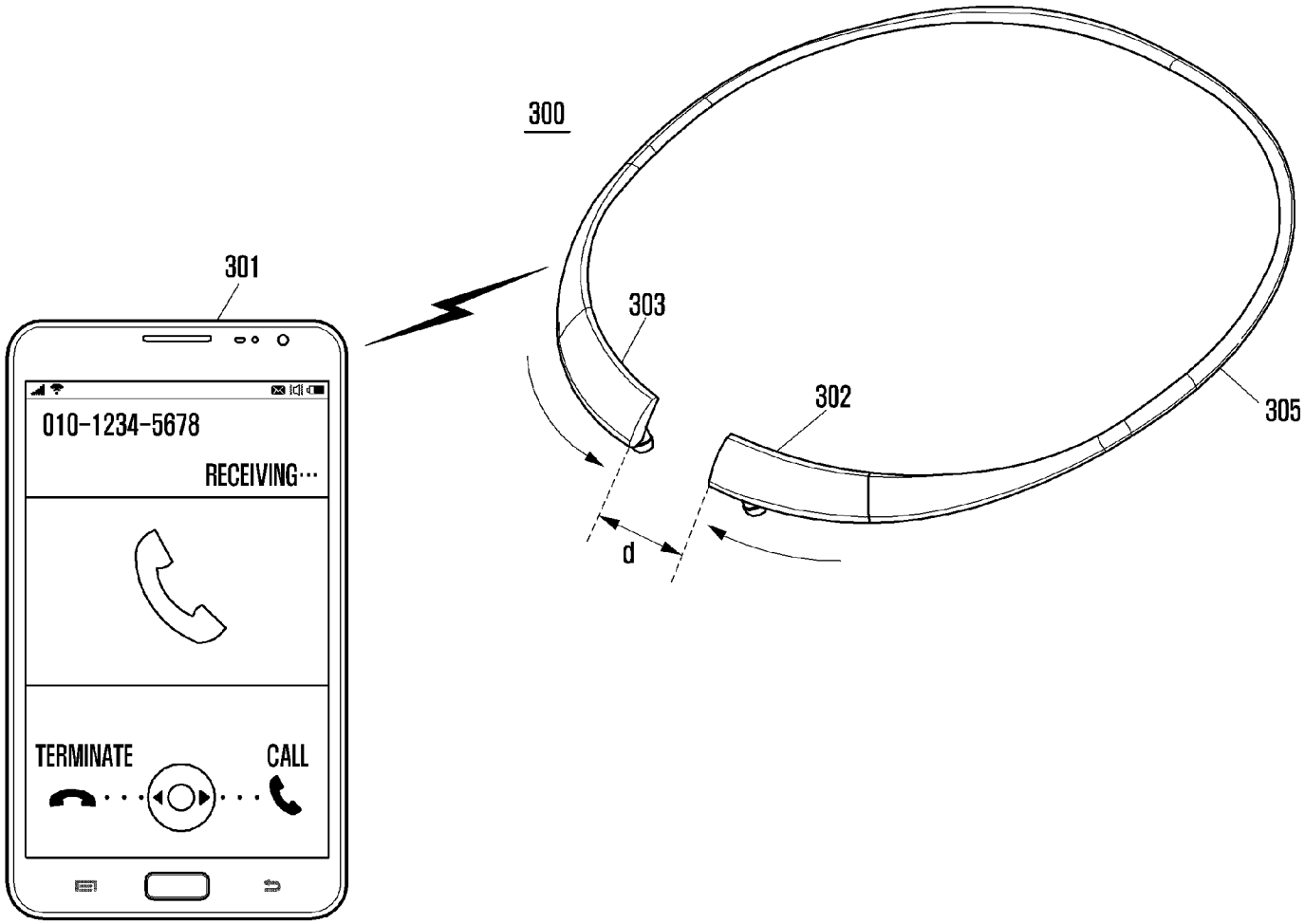
FIG. 5B illustrates components of the control information transmission operation of FIG. 5A.

FIG. 5B illustrates components of the control information transmission operation of FIG. 5A.

Referring to FIGS. 5A and 5B, the sound output device 300 is connected to the electronic device 301 in step 510 and receives sound information according to a call reception standby function from the electronic device 301.

The sound output device 300 can sense at least one of the coupling state between the first coupling unit 302 and the second coupling unit 303 which are included in the body 305, a separation distance, and a separation time through the sensor module 120 in step 512. For example, as shown in FIG. 5B, when a user separates and then re-couples the first coupling unit 302 and the second coupling unit 303, in order to block an incoming call, the sound output device 300 can sense the separation between the first coupling unit 302 and the second coupling unit 303 or the coupling of the first coupling unit 302 and the second coupling unit 303. Further, the sensor module 120 can sense the separation distance d or the separation time between the first coupling unit 302 and the second coupling unit 303.

According to the present invention, the sound output device 300 can sense the elapsed time from when the first coupling unit 302 and the second coupling unit 303 are separated from each other to when the first coupling unit 302 and the second coupling unit 303 are coupled to each other again, as the separation time. The separation time can be used for generating control information for activating a call reception rejecting function.

If the first coupling unit 302 and the second coupling unit 303 are separated from each other, the sound output device 300 can determine whether the separation time until the first coupling unit 302 and the second coupling unit 303 are coupled again is within the predetermined time in step 514. The predetermined time, for example, may be set as three seconds.

If the separation time between the first coupling unit 302 and the second coupling unit 303 is within the predetermined time, the sound output device 300 can transmit control information for activating a call reception rejecting function of the electronic device 301 to the electronic device 301 in step 516. For example, if the predetermined time is set as three seconds, when a user separates and then couples the first coupling unit 302 and the second coupling unit 303 again within three seconds in order to block an incoming call, the sound output device 300 can sense the recoupling and generate control information for activating a call reception rejecting function. After that, the sound output device 300 can activate a call reception rejecting function by transmitting the generated control information to the electronic device 301.

If the separation time between the first coupling unit 302 and the second coupling unit 303 exceeds the predetermined time, the sound output device 300 returns to step 510 and maintains the operation of receiving sound information according to a call reception standby function from an electronic device.

Figure 6A:
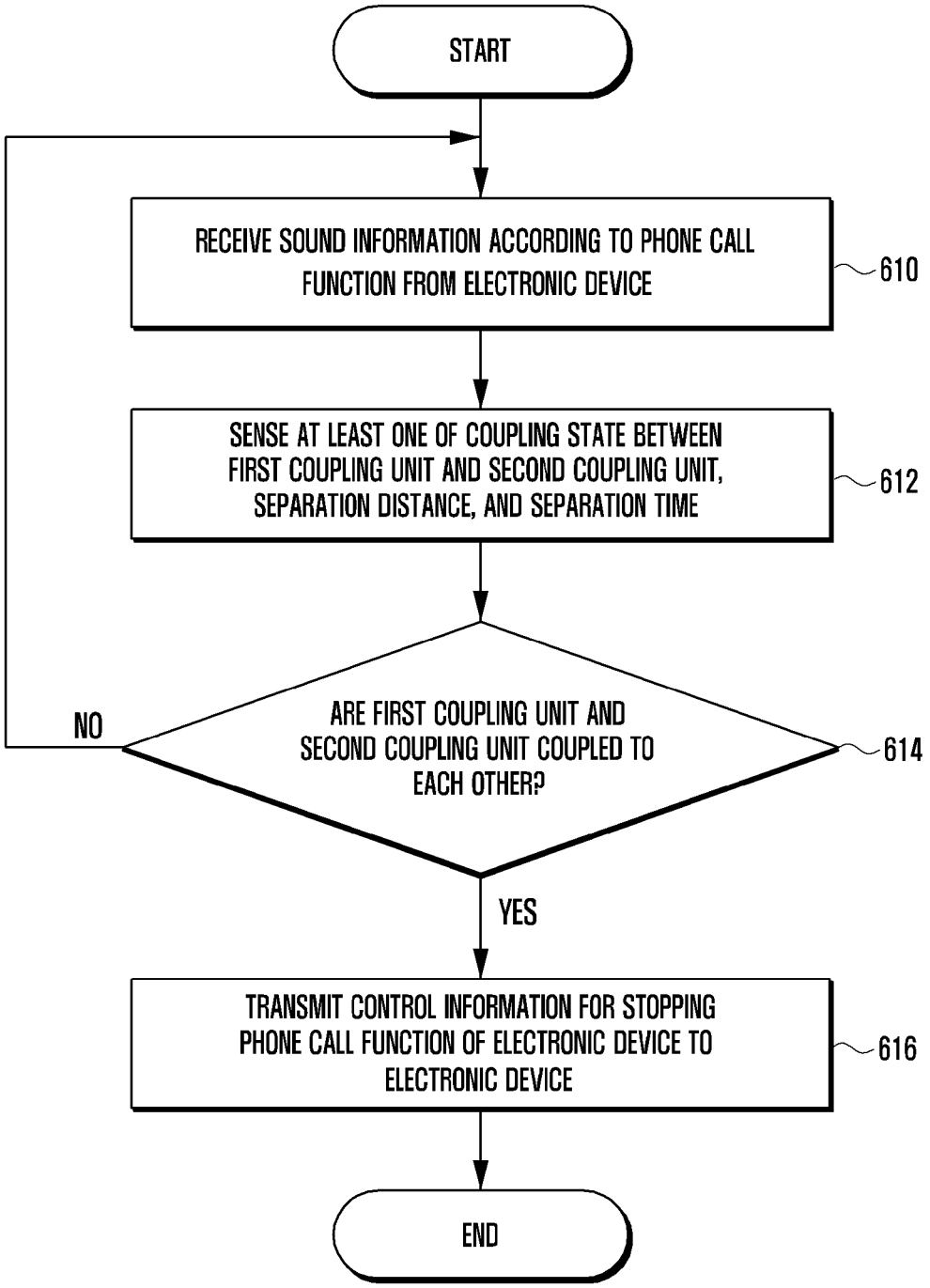
FIG. 6A is a flow chart of an operation of transmitting control information to discontinue a phone call function to an electronic device by a sound output device according to an embodiment of the present invention.

FIG. 6A is a flow chart of an operation of transmitting control information to discontinue a phone call function to the electronic device 301 by the sound output device 300 according to an embodiment of the present invention.

Figure 6B:
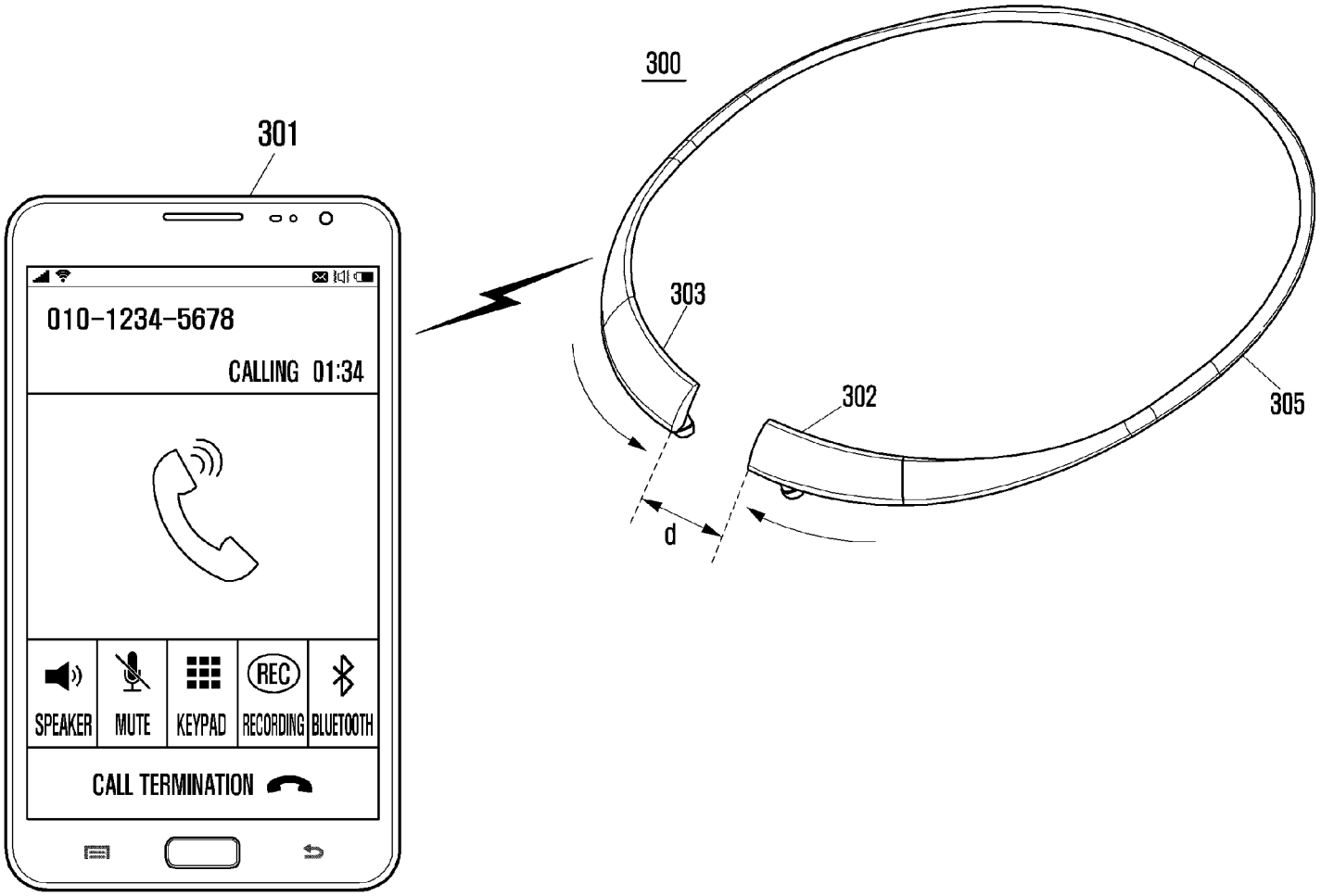
FIG. 6B illustrates components of the control information transmission operation of FIG. 6A.

FIG. 6B illustrates components of the control information transmission operation of FIG. 6A.

Referring to FIGS. 6A and 6B, the sound output device 300 is connected to the electronic device 301 in step 610 and can receive sound information according to a phone call function from the electronic device 301.

The sound output device 300 can sense at least one of the coupling state between the first coupling unit 302 and the second coupling unit 303 which are included in the body 305, a separation distance, and a separation time through the sensor module 120 in step 612. For example, as shown in FIG. 6B, if a user couples the first coupling unit 302 and the second coupling unit 303, the sound output device 300 can sense the coupling of the first coupling unit 302 and the second coupling unit 303. The coupling state can be used for generating control information to discontinue a phone call function.

The sound output device 300 can determine whether the first coupling unit 302 and the second coupling unit 303 are coupled to each other in step 614.

If the first coupling unit 302 and the second coupling unit 303 are coupled to each other, the sound output device 300 can transmit control information to discontinue a phone call function of the electronic device 301 to the electronic device 301 in step 616. For example, if a user terminates a call and then couples the first coupling unit 302 and the second coupling unit 303 together, the sound output device 300 can sense the coupling and generate control information to discontinue a phone call function. After that, the sound output device 300 can discontinue a phone call function by transmitting the generated control information to the electronic device 301.

If the first coupling unit 302 and the second coupling unit 303 are not coupled to each other, the sound output device 300 returns to step 610 and maintains the operation of receiving sound information according to a phone call function from an electronic device.

Figure 7A:
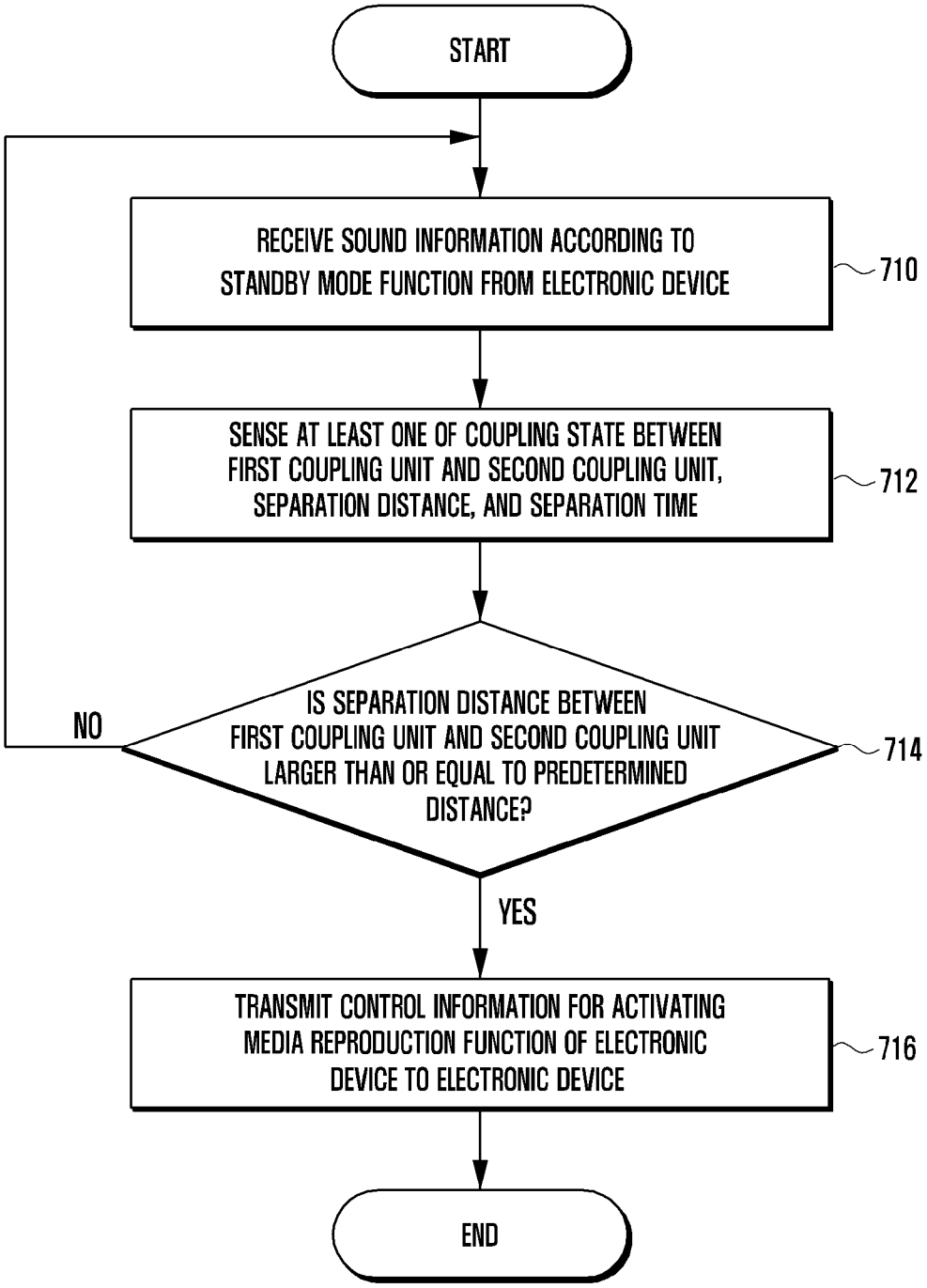
FIG. 7A is a flow chart of an operation of transmitting control information for activating a media reproduction function to an electronic device by a sound output device according to an embodiment of the present invention.

FIG. 7A is a flow chart of an operation of transmitting control information for activating a media reproduction function to the electronic device 301 by the sound output device 300 according to an embodiment of the present invention.

Figure 7B:
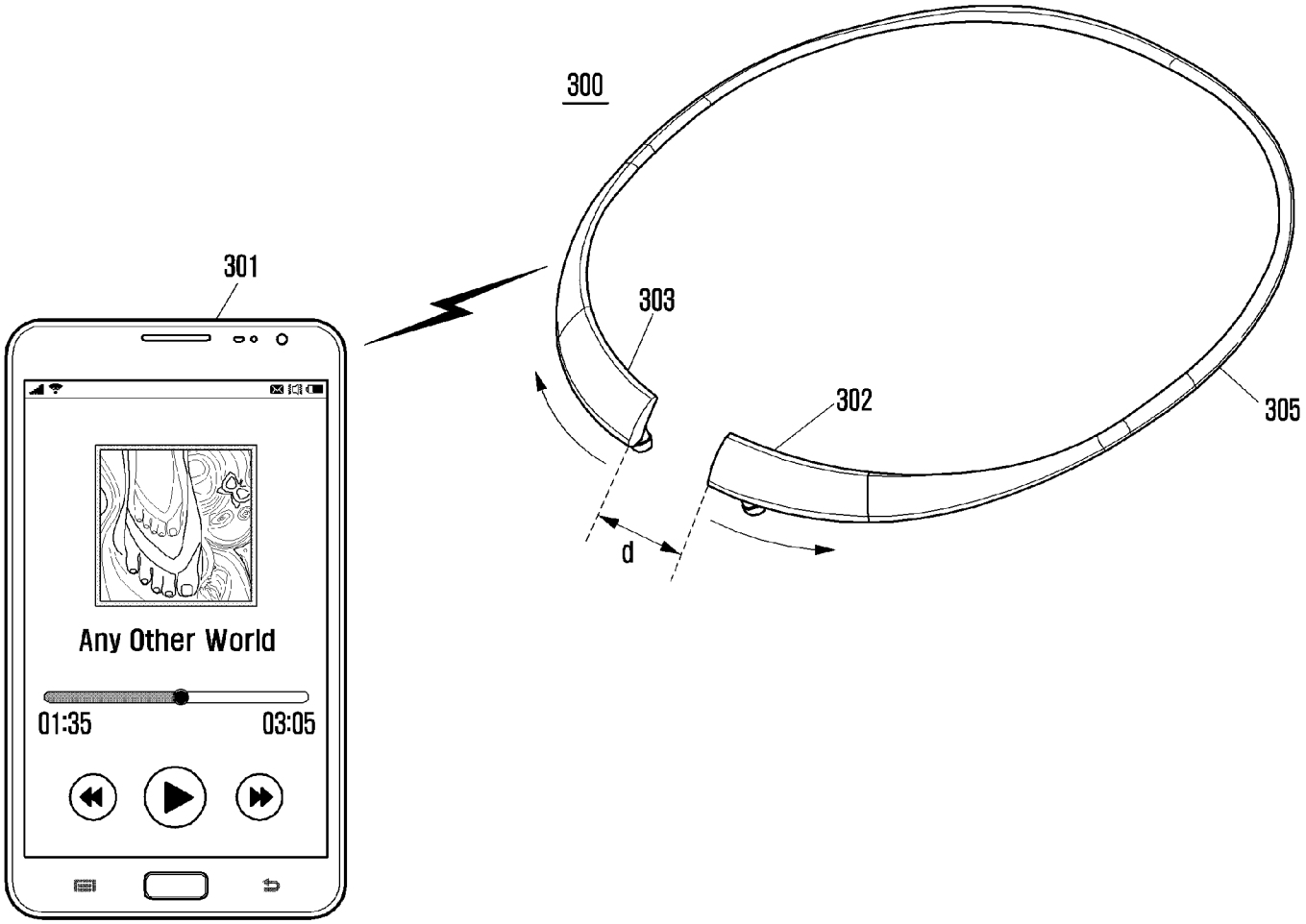
FIG. 7B illustrates components of the control information transmission operation of FIG. 7A.

FIG. 7B illustrates components of the control information transmission operation of FIG. 7A.

Referring to FIGS. 7A and 7B, the sound output device 300 is connected to the electronic device 301 in step 710 and can receive sound information according to a standby mode function from the electronic device 301. The sound information according to the standby mode function can include an audio signal indicating a sound effect of the electronic device 301 which is in a standby mode, and the sound output device 300 can output a sound on the basis of the audio signal.

The sound output device 300 can sense at least one of the coupling state between the first coupling unit 302 and the second coupling unit 303 which are included in the body 305, a separation distance, and a separation time through the sensor module 120 in step 712. For example, as shown in FIG. 7B, when a user separates the first coupling unit 302 and the second coupling unit 303 in order to reproduce a media, the sound output device 300 can sense the coupling of the first coupling unit 302 and the second coupling unit 303. Further, the sensor module 120 can sense the separation distance d or the separation time between the first coupling unit 302 and the second coupling unit 303.

According to the present invention, the sound output device 300 can sense the elapsed time from when the first coupling unit 302 and the second coupling unit 303 are separated from each other, as the separation time. Further, the sound output device 300 can sense the elapsed time from when a distance between the first coupling unit 302 and the second coupling unit 303 is greater than or equal to a predetermined distance, as the separation time. For example, the sound output device 300 can measure how much time passes from when a user spaces the first coupling unit 302 and the second coupling unit 303 from each other by the predetermined distance. The separation distance d or the separation time may be used for generating control information for activating a media reproduction function.

When the first coupling unit 302 and the second coupling unit 303 are separated from each other, the sound output device 300 can determine whether the distance d between the first coupling unit 302 and the second coupling unit 303 is greater than or equal to the predetermined distance in step 714. The predetermined distance may be set as a distance between both ears of a user, for example, 20 cm.

When the separation distance d between the first coupling unit 302 and the second coupling unit 303 is greater than or equal to the predetermined distance, the sound output device 300 can transmit control information for activating a media reproduction function of the electronic device 301 to the electronic device 301 in step 716. For example, if the predetermined distance is set as 20 cm, when a user spaces the first coupling unit 302 and the second coupling unit 303 away from each other by the distance d of 20 cm in order to hear a voice through a speaker, the sound output device 300 can sense the spacing and generate control information for activating a media reproduction function. After that, the sound output device 300 can activate a media reproduction function by transmitting the generated control information to the electronic device 301.

According to the present invention, if the predetermined time elapses from when the separation distance d between the first coupling unit 302 and the second coupling unit 303 is greater than or equal to the predetermined distance, the sound output device 301 can transmit control information for activating a media reproduction function of the electronic device 301 to the electronic device 301. For example, if the predetermined distance is set as 20 cm and the predetermined time is set as two seconds, when two seconds elapse from when a user spaces the first coupling unit 302 and the second coupling unit 303 away from each other by the distance d of 20 cm in order to hear a voice through a speaker, the sound output device 300 can sense the elapsed time and generate control information for activating a media reproduction function. After that, the sound output device 300 can activate a media reproduction function by transmitting the generated control information to the electronic device 301.

According to the present invention, if the distance d between the first coupling unit 302 and the second coupling unit 303 is greater than or equal to the predetermined distance after reproduction of a media is stopped, the sound output device 300 can transmit control information for activating reproduction of a media which has been recently stopped to the electronic device 301. For example, if the predetermined distance is set as 20 cm and the predetermined time is set as one hour, when a user spaces the first coupling unit 302 and the second coupling unit 303 away from each other by the distance d of more than 20 cm within one hour from when reproduction of a media was stopped, the sound output device 300 can sense the spacing and generate control information for reproducing a media which has been recently stopped. After that, the sound output device 300 can reproduce the media which has been recently stopped by transmitting the generated control information to the electronic device 301.

If the distance d between the first coupling unit 302 and the second coupling unit 303 is less than the predetermined distance, the sound output device 300 returns to operation 710 and maintains the operation of receiving sound information according to a standby mode function from an electronic device.

Figure 8A:
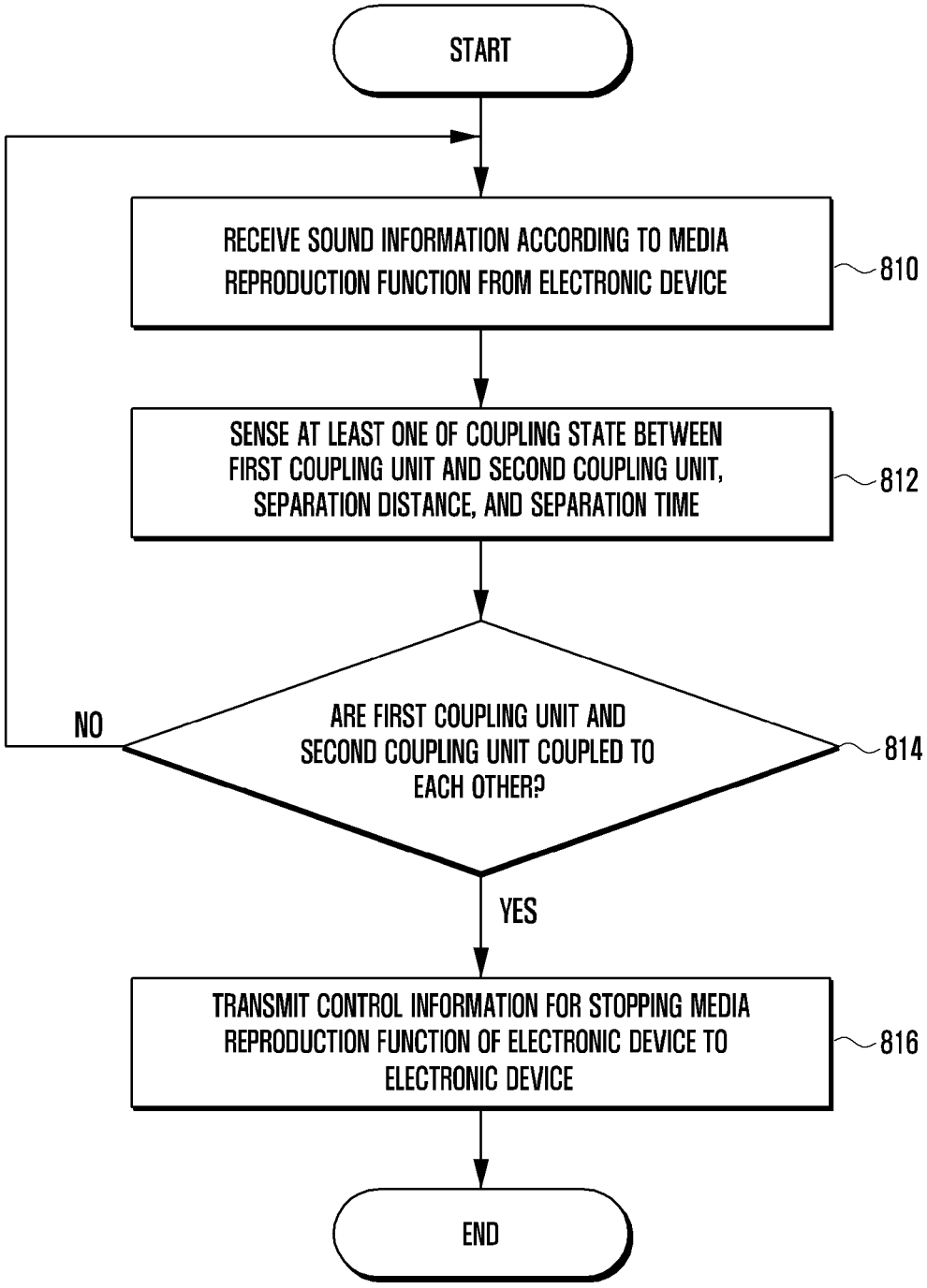
FIG. 8A is a flow chart of an operation of transmitting control information to discontinue a media reproduction function to an electronic device by a sound output device according to an embodiment of the present invention.

FIG. 8A is a flow chart of an operation of transmitting control information for stopping a media reproduction function to the electronic device 301 by the sound output device 300 according to an embodiment of the present invention.

Figure 8B:
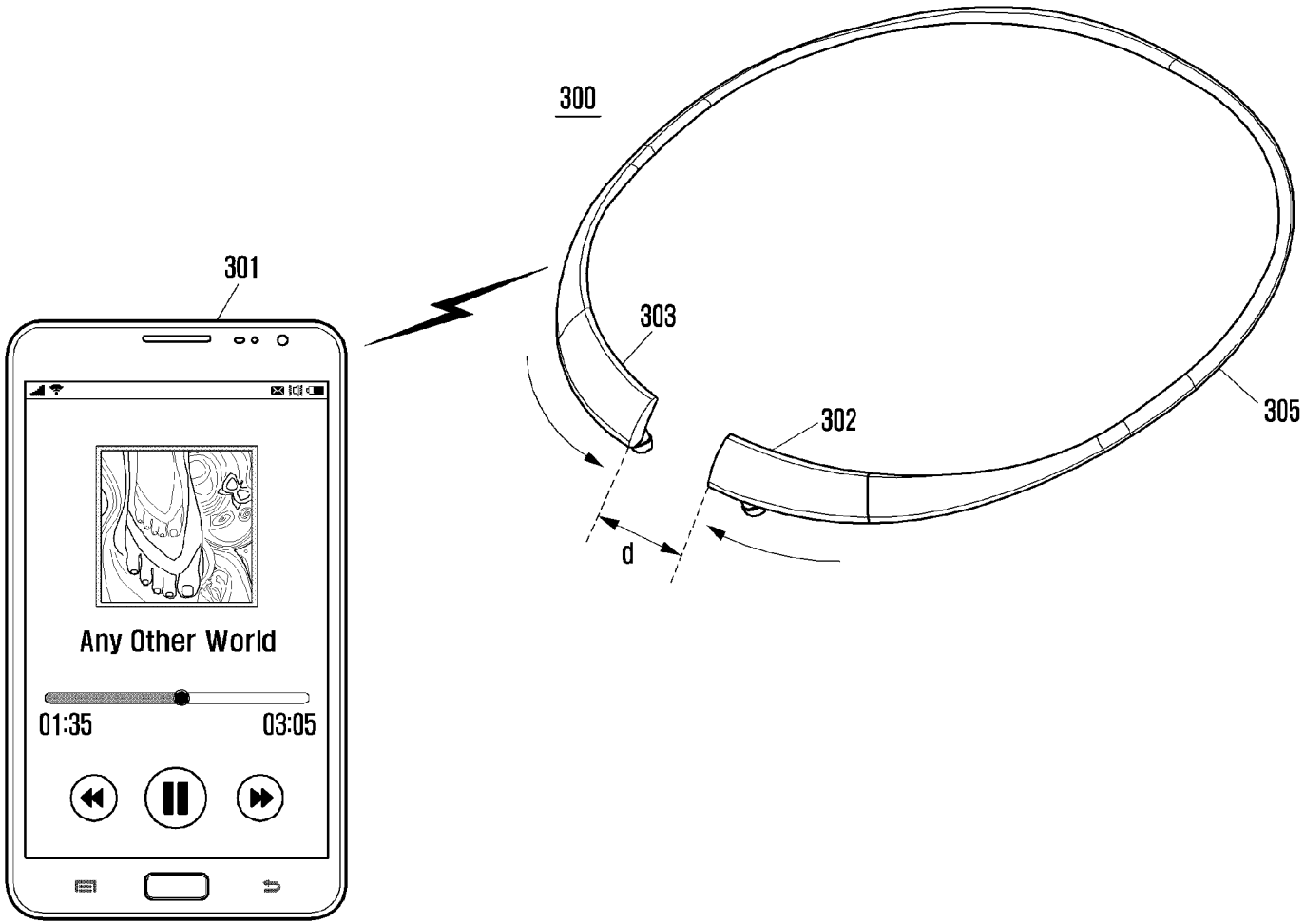
FIG. 8B illustrates components of the control information transmission operation of FIG. 8A.

FIG. 8B illustrates components of the control information transmission operation of FIG. 8A.

Referring to FIGS. 8A and 8B, the sound output device 300 is connected to the electronic device 301 in step 810 and can receive sound information according to a media reproduction function from the electronic device 301. The sound information according to the media reproduction function can include an audio signal indicating a sound effect or a background sound of a media, and the sound output device 300 can output a sound on the basis of the audio signal.

The sound output device 300 can sense at least one of the coupling state between the first coupling unit 302 and the second coupling unit 303 which are included in the body 305, a separation distance, and a separation time through the sensor module 120 in step 812. For example, as shown in FIG. 8B, if a user couples the first coupling unit 302 and the second coupling unit 303 together in order to terminate media reproduction, the sound output device 300 can sense the coupling of the first coupling unit 302 and the second coupling unit 303. The coupling state may be used for generating control information terminating a media reproduction function.

The sound output device 300 can determine whether the first coupling unit 302 and the second coupling unit 303 are coupled to each other in step 814.

If the first coupling unit 302 and the second coupling unit 303 are coupled to each other, the sound output device 300 can transmit control information for stopping a media reproduction function of the electronic device 301 to the electronic device 301 in step 816. For example, when a user couples the first coupling unit 302 and the second coupling unit 303 together in order to terminate a media being reproduced, the sound output device 300 can sense the coupling and generate control information for stopping a media reproduction function. After that, the sound output device 300 can stop a media reproduction function by transmitting the generated control information to the electronic device 301.

If the first coupling unit 302 and the second coupling unit 303 are not coupled to each other, the sound output device 300 returns to step 810 and maintains the operation of receiving sound information according to a media reproduction function from an electronic device.

Figure 9:
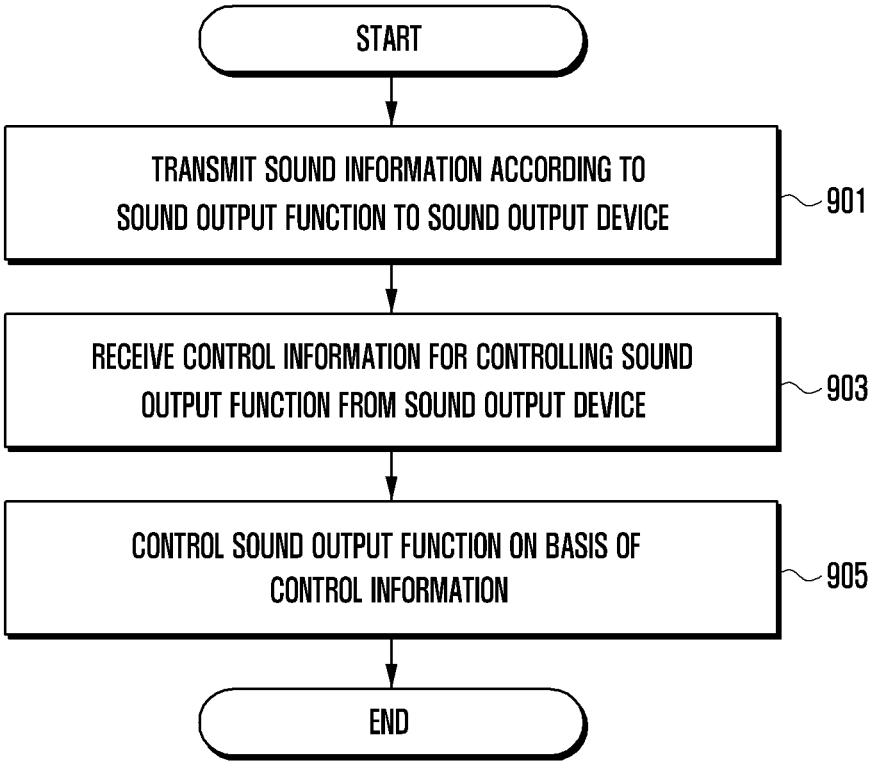
FIG. 9 is a flow chart of an operation of controlling a sound output function by an electronic device according to an embodiment of the present invention.

FIG. 9 is a flow chart of an operation of controlling a sound output function by the electronic device 301 according to an embodiment of the present invention.

Referring to FIG. 9, the electronic device 301 is connected to the sound output device 300 in step 901 and can transmit sound information according to a sound output function to the sound output device 300. The sound output function may include various functions performed in the electronic device 301, such as a call reception standby function, a call reception rejecting function, a phone call function, a standby mode function, and a media reproduction function. The sound information transmitted to the electronic device 300 may include an audio signal according to the sound output function.

According to the present invention, when a call reception standby function is performed, the electronic device 301 can transmit vibration echo information to the sound output device 300. The vibration echo information may include a signal for controlling the vibration motor 150 of the sound output device 300 so as to enable a user to be aware of an incoming call. The sound output device 300 can operate the vibration motor 150 on the basis of a signal for controlling the vibration motor.

The electronic device 301 can receive control information for controlling a sound output function from the sound output device 300 in step 903.

The electronic device 301 can control a sound output function on the basis of the control information which the electronic device 301 has received from the sound output device 300 in step 905. If the electronic device 301 receives control information for activating a phone call function from the sound output device 300 while performing a call reception standby function, the electronic device 301 converts the call reception standby function into a phone call function to enable a user to make a phone call to another person. If the electronic device 301 receives control information for activating a call reception rejecting function from the sound output device 300 while performing a call reception standby function, the electronic device 301 converts the call reception standby function into a call reception rejecting function to enable a user to refuse to receive an incoming call. If the electronic device 301 receives control information to discontinue a phone call function from the sound output device 300 while performing a phone call function, the electronic device 301 stops the phone call function to enable a user to terminate a phone call to another person. If the electronic device 301 receives control information for activating a media reproduction function from the sound output device 300 while performing a standby mode function, the electronic device 301 can reproduce a media by converting the standby mode function into a media reproduction function. If the electronic device 301 receives control information for stopping a media reproduction function from the sound output device 300 while performing a media reproduction function, the electronic device 301 terminates a media being reproduced by stopping the media reproduction function.

According to an embodiment of the present invention, at least some of the devices (for example, modules or functions thereof) or the method (for example, operations) may be implemented by a command stored in a computer-readable storage medium in a programming module form. When the command is executed by one or more processors (for example, the processor 110), the one or more processors may execute a function corresponding to the command. The computer-readable storage medium may be, for example, the memory. At least some of the programming modules may be implemented or executed by, for example, the processor 110. At least some of the programming modules may include, for example, a module, a program, a routine, a set of instructions or a process for performing one or more functions.

The computer readable recording medium may include magnetic media such as, for example, a hard disc, a floppy disc, and a magnetic tape, optical media such as a CD-ROM and a DVD, magneto-optical media such as a floptical disk, and hardware devices specifically configured to store and execute program commands, such as a ROM, a RAM, and a flash memory. In addition, the program instructions may include high class language codes, which can be executed in a computer by using an interpreter, as well as machine codes made by a compiler. The aforementioned hardware devices may be configured to operate as one or more software modules in order to perform the operations described in the present disclosure, and vice versa.

The programming module, according to an embodiment the present invention, may include one or more of the aforementioned components or may further include other additional components, or some of the aforementioned components may be omitted. Operations executed by a module, a programming module, or other component elements, according to an embodiment of the present invention, may be executed sequentially, in parallel, repeatedly, or in a heuristic manner. Further, some operations may be executed according to another order or may be omitted, or other operations may be added.

While the invention has been shown and described with reference to certain embodiments thereof, it will be understood by those skilled in the art that various changes in form and detail may be made therein without departing from the spirit and scope of the invention as defined by the appended claims, and equivalents thereof.

What is claimed is:

1. A sound output device comprising:

a first speaker;

a second speaker;

a first coupling unit;

a second coupling unit configured to be coupled to the first coupling unit;

a sensor module configured to sense at least one of a coupling state between the first coupling unit and the second coupling unit, a separation distance between the first coupling unit and the second coupling unit, and a separation time;

a communication module configured to establish a communication channel with an electronic device; and a processor configured to receive, from the electronic device, sound information corresponding to a sound output function of the electronic device, generate control information for controlling the sound output function of the electronic device on the basis of at least one of the coupling state between the first coupling unit and the second coupling unit, the separation distance, and the separation time, and transmit the generated control information to the electronic device, wherein the first speaker and the second speaker are configured to output sound received from the electronic device.

2. The sound output device of claim 1, wherein the processor is configured to transmit to the electronic device control information for activating a phone call function of the electronic device in response to receiving sound information corresponding to a call reception standby function from the electronic device, if the separation distance is greater than or equal to a predetermined distance.

3. The sound output device of claim 1, wherein the processor is configured to transmit to the electronic device control information for activating a phone call function of the electronic device in response to receiving sound information corresponding to a call reception standby function from the electronic device, if the first coupling unit and the second coupling unit are spaced away from each other by more than a predetermined distance for a predetermined time.

4. The sound output device of claim 1, wherein the processor is configured to transmit to the electronic device control information for activating a call reception rejecting function of the electronic device in response to receiving sound information corresponding to a call reception standby function from the electronic device, if the first coupling unit and the second coupling unit are separated and then recoupled within a predetermined time.

5. The sound output device of claim 1, wherein the processor is configured to transmit to the electronic device control information to discontinue a phone call function of the electronic device in response to receiving sound information corresponding to a phone call function from the electronic device, if the first coupling unit and the second coupling unit are coupled.

6. The sound output device of claim 1, wherein the processor is configured to transmit to the electronic device control information for activating a media reproduction function of the electronic device in response to receiving sound information corresponding to a standby mode function from the electronic device, if the separation distance is greater than or equal to a predetermined distance.

7. The sound output device of claim 1, wherein the processor is configured to transmit to the electronic device control information for stopping a media reproduction function of the electronic device in response to receiving sound information corresponding to a media reproduction function from the electronic device, if the first coupling unit and the second coupling unit are coupled.

8. The sound output device of claim 7, wherein the processor is configured to transmit to the electronic device control information for reproducing the stopped media, if the first coupling unit and the second coupling unit are spaced away from each other by more than a predetermined distance after the media reproduction has stopped.

9. The sound output device of claim 1, wherein the sensor module includes at least one of a Hall sensor, a proximity sensor, and a capacitive sensor.

10. The sound output device of claim 1, further comprising a body including the first coupling unit and the second coupling unit.

11. A method of outputting sound by a sound output device in which a first coupling unit and a second coupling unit can be coupled, the method comprising:

receiving, from an electronic device, sound information corresponding to a sound output function of the electronic device;

sensing at least one of a coupling state between the first coupling unit and the second coupling unit, a separation distance between the first coupling unit and the second coupling unit, and a separation time; and generating control information for controlling the sound output function of the electronic device on the basis of at least one of the coupling state between the first coupling unit and the second coupling unit, the separation distance, and the separation time, and transmitting the generated control information to the electronic device.

12. The method of claim 11, wherein transmitting the generated control information to the electronic device includes transmitting control information for activating a phone call function of the electronic device in response to receiving sound information corresponding to a call reception standby function from the electronic device, if the separation distance is greater than or equal to a predetermined distance.

13. The method of claim 12, wherein transmitting the generated control information to the electronic device includes transmitting control information for activating a phone call function of the electronic device in response to receiving sound information corresponding to a call reception standby function from the electronic device, if the first coupling unit and the second coupling unit are spaced away from each other by more than a predetermined distance for a predetermined time.

14. The method of claim 11, wherein transmitting the generated control information to the electronic device includes transmitting control information for activating a call reception rejection function of the electronic device in response to receiving sound information corresponding to a call reception standby function from the electronic device, if the first coupling unit and the second coupling unit are separated and then re-coupled within a predetermined time.

15. The method of claim 11, wherein transmitting the generated control information to the electronic device includes transmitting control information to discontinue a phone call function of the electronic device in response to receiving sound information corresponding to a phone call function from the electronic device, if the first coupling unit and the second coupling unit are coupled.

16. The method of claim 11, wherein transmitting the generated control information to the electronic device includes transmitting control information for activating a media reproduction function of the electronic device in response to receiving sound information corresponding to a standby mode function from the electronic device, if the separation distance between the first coupling unit and the second coupling unit is greater than or equal to a predetermined distance.

17. The method of claim 11, wherein transmitting the generated control information to the electronic device includes transmitting control information for stopping a media reproduction function of the electronic device in response to receiving sound information corresponding to a media reproduction function from the electronic device, if the first coupling unit and the second coupling unit are coupled.

18. The method of claim 17, wherein transmitting the generated control information to the electronic device includes transmitting control information for reproducing the stopped media, if the first coupling unit and the second coupling unit are spaced away from each other by more than a predetermined distance after the media reproduction has stopped.

19. The method of claim 11, wherein the sensing the coupling state uses at least one of a Hall sensor, a proximity sensor, and a capacitive sensor.

* * * * *